US007666826B2

(12) United States Patent
Smith et al.

(10) Patent No.: US 7,666,826 B2
(45) Date of Patent: Feb. 23, 2010

(54) FOAM DISPENSER FOR USE IN FOAMING CLEANING COMPOSITION

(75) Inventors: Kim R. Smith, Woodbury, MN (US); Keith E. Olson, Apple Valley, MN (US)

(73) Assignee: Ecolab Inc., St. Paul, MN (US)

( * ) Notice: Subject to any disclaimer, the term of this patent is extended or adjusted under 35 U.S.C. 154(b) by 748 days.

(21) Appl. No.: 10/852,591

(22) Filed: May 24, 2004

(65) Prior Publication Data

US 2005/0003990 A1 Jan. 6, 2005

Related U.S. Application Data

(63) Continuation-in-part of application No. 10/723,455, filed on Nov. 25, 2003, now Pat. No. 7,592,301.

(60) Provisional application No. 60/458,196, filed on Nov. 27, 2002.

(51) Int. Cl.
*C11D 17/00* (2006.01)

(52) U.S. Cl. ..... 510/180; 510/181; 510/182; 510/475; 510/479; 510/499

(58) Field of Classification Search ..... None
See application file for complete search history.

(56) References Cited

U.S. PATENT DOCUMENTS 4,260,528 A 4/1981 Fox et al.
4,670,171 A 6/1987 Magyar
4,921,629 A 5/1990 Malihi et al.
5,273,677 A 12/1993 Arif
5,352,376 A 10/1994 Gutzman
5,444,094 A 8/1995 Malik et al.
5,447,648 A 9/1995 Steindorf
5,486,307 A 1/1996 Misselyn et al.
5,501,815 A 3/1996 Man
5,516,452 A 5/1996 Welch et al.
5,534,198 A 7/1996 Masters et al.

(Continued)

FOREIGN PATENT DOCUMENTS

EP 0 595 590 A 5/1994

(Continued)

OTHER PUBLICATIONS

U.S. Appl. No. 10/758,688, filed Jan. 15, 2004.

(Continued)

*Primary Examiner*—Necholus Ogden, Jr.
(74) *Attorney, Agent, or Firm*—Faegre & Benson LLP

(57) ABSTRACT

A foam cleaning composition is provided that includes about 0.05 wt. % to about 10 wt. % total amount of surfactant, at least about 80 wt. % water, and a foam-boosting solvent having a HLB value of at least about 6.9 and an OHLB value of between about 12 and about 20. The foam-boosting solvent is provided at a weight ratio of the foam-boosting solvent to the total amount of surfactant of at least about 1:100. The foam cleaning composition exhibits at least 50 wt. % foam according to a 15 second vertical separation test. A foam dispenser and a method for foaming a cleaning composition are provided.

15 Claims, 2 Drawing Sheets

U.S. PATENT DOCUMENTS

| | | | |
|---|---|---|---|
| 5,534,199 | A | 7/1996 | Winkler, III |
| 5,545,352 | A | 8/1996 | Pike |
| 5,552,079 | A | 9/1996 | Roach et al. |
| 5,589,099 | A | 12/1996 | Baum |
| 5,602,093 | A | 2/1997 | Haerer et al. |
| 5,712,244 | A | 1/1998 | Addison et al. |
| 5,739,099 | A | 4/1998 | Welch et al. |
| 5,750,482 | A | 5/1998 | Cummings |
| 5,798,324 | A | 8/1998 | Svoboda |
| 5,849,681 | A | 12/1998 | Neumiller et al. |
| 5,866,524 | A | 2/1999 | Wevers |
| 5,880,088 | A | 3/1999 | Lentsch et al. |
| 5,906,992 | A | 5/1999 | Fonsny |
| 6,053,364 | A | 4/2000 | Van der Heijden |
| 6,096,702 | A | 8/2000 | Ramirez et al. |
| 6,235,692 | B1 | 5/2001 | Scoville et al. |
| D452,653 | S | 1/2002 | Boshuizen et al. |
| D452,822 | S | 1/2002 | Boshuizen et al. |
| D456,260 | S | 4/2002 | Boshuizen et al. |
| 6,420,326 | B1 | 7/2002 | Maile et al. |
| 6,673,760 | B1 | 1/2004 | Lentsch et al. |
| 2002/0002125 | A1* | 1/2002 | Colurciello, Jr. et al. .... 510/238 |
| 2002/0072481 | A1 | 6/2002 | Hubert et al. |
| 2003/0162678 | A1 | 8/2003 | Ashton |
| 2004/0154640 | A1 | 8/2004 | Smith et al. |

FOREIGN PATENT DOCUMENTS

| | | | |
|---|---|---|---|
| EP | 0 630 965 | A | 12/1994 |
| GB | 2311537 | A | 10/1997 |
| JP | 1001790 | | 1/1998 |
| WO | WO 94/14942 | A | 7/1994 |
| WO | WO 96/08553 | | 3/1996 |
| WO | WO 96/10068 | | 4/1996 |
| WO | WO97/25408 | | 7/1997 |
| WO | WO98/44080 | | 10/1998 |
| WO | WO 00/39268 | A | 7/2000 |
| WO | WO 02/12422 | A | 2/2002 |
| WO | WO02/055641 | | 7/2002 |

OTHER PUBLICATIONS

Rosen, M., Characteristic Features of Surfactants, *Surfactants and Interfacial Phenomena*, Second Edition, John Wiley & Sons, 1989, pp. 7-17.

Acusol Detergent Polymers, "Physical Properties and General Applications," Rohm & Haas, Jun. 1998.

"Solvent HLB and OHLB Values for DOW Glycol Ethers," *DOW*, 3 pgs. (Date Unknown).

* cited by examiner

FOAM DISPENSER FOR USE IN FOAMING CLEANING COMPOSITION

CROSS REFERENCE TO RELATED APPLICATIONS

This application is a continuation-in-part application of U.S. application Ser. No. 10/723,455 that was filed with the United States Patent and Trademark Office on Nov. 25, 2003 now U.S. Pat. No. 7,592,301. U.S. application Ser. No. 10/723,455 claims priority to U.S. Provisional Patent Application Ser. No. 60/458,196 that was filed with the United States Patent and Trademark Office on Nov. 27, 2002. U.S. application Ser. No. 10/723,455 and U.S. Provisional Patent Application Ser. No. 60/458,196 are incorporated herein by reference.

FIELD OF THE INVENTION

The present invention relates to a foam cleaning composition, a method for foaming a cleaning composition, and a foam dispenser. The cleaning composition is provided so that it foams as a result of processing through a mechanical foaming head as a result of combining the cleaning composition with air. The foam dispenser includes a mechanical foaming head and a container that includes the cleaning composition, and the mechanical foaming head and the container can be operated by finger pressure to generate the cleaning composition in the form of a foam without the use of an aerosol.

BACKGROUND

There are a number of cleaning products on the market that foam as a result of a propellant. These types of products can be referred to as aerosols. Exemplary commercial aerosol products are available under the names Windex Powerized Foaming Glass & Multi-Surface Cleaner from S.C. Johnson, and Spray Cleaner from Ecolab Inc.

An exemplary product that can be foamed using a mechanical foaming head is available under the name Scrubbing Bubbles from S.C. Johnson.

Exemplary patents and publications that describe compositions that can be foamed include U.S. Pat. No. 4,921,629 to Malihi et al.; U.S. Pat. No. 6,096,702 to Ramirez et al.; U.S. Pat. No. 5,866,524 to Wevers; and U.S. Patent Publication No. US2002/0072481 to Hubert et al.

SUMMARY OF THE INVENTION

Figure 1:
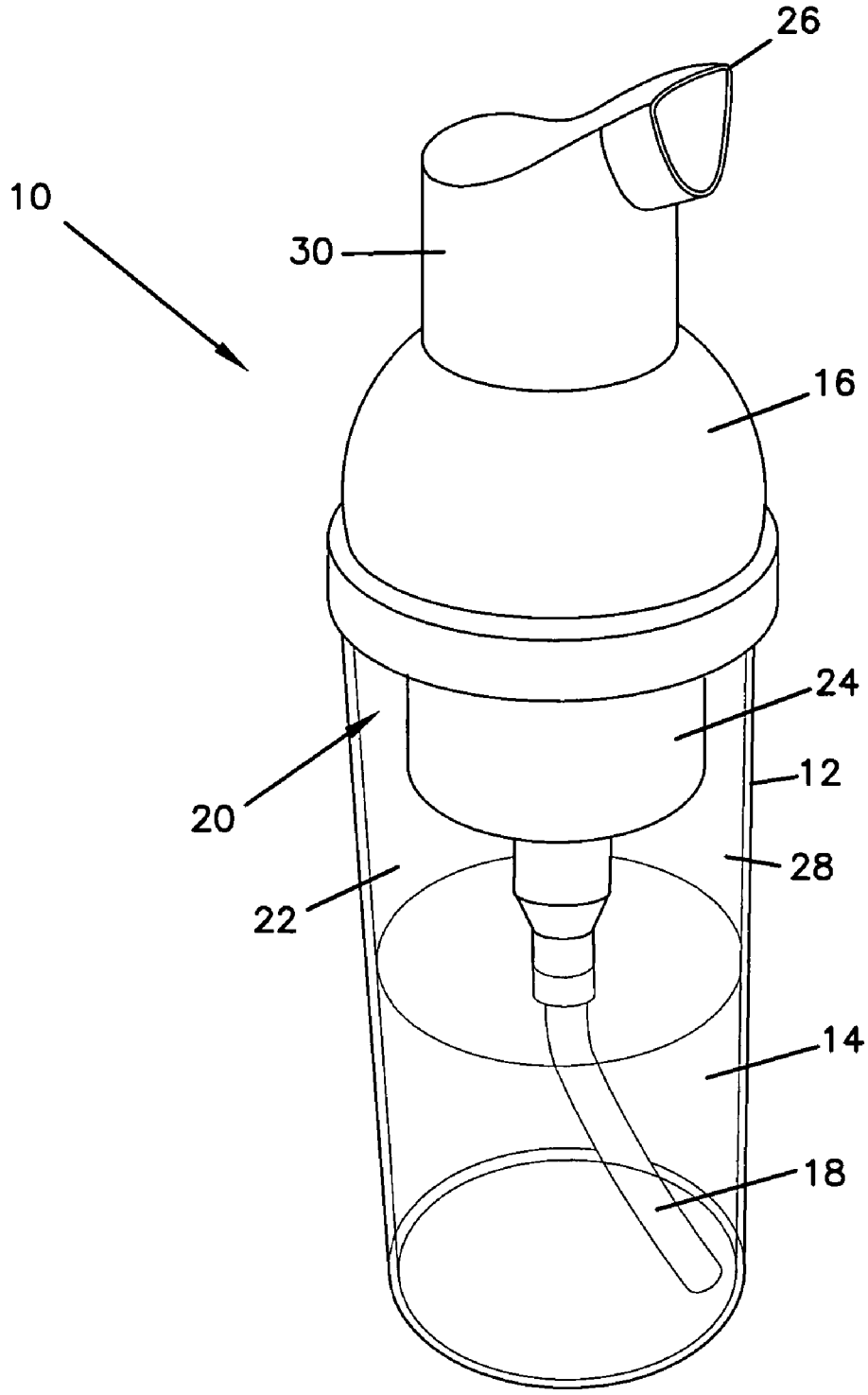
FIG. 1 is a perspective view of a foam dispenser according to the principles of the invention.

A foam cleaning composition is provided according to the invention. The foam cleaning composition includes about 0.05 wt. % to about 10 wt. % total amount of surfactant, at least about 80 wt. % water, and a foam-boosting solvent having a HLB value of at least about 6.9 and an OHLB value of between about 12 and about 20. The foam-boosting solvent is provided at a weight ratio of the foam-boosting solvent to the total amount of surfactant of at least about 1:100. The foam cleaning composition exhibits at least 50 wt. % foam according to a 15 second vertical separation test after foaming in a mechanical foaming head.

A foam dispenser is provided according to the invention. The foam dispenser includes a container and a mechanical foaming head. The container includes a cleaning composition containing about 0.05 wt. % to about 10 wt. % total amount of surfactant, at least about 80 wt. % water, and a foam-boosting solvent having a HLB value of at least about 6.9 and an OHLB value of between about 12 and about 20, and the weight ratio of the foam-boosting solvent to the total amount of surfactant is at least about 1:100. The mechanical foaming head includes an air and liquid mixing chamber; an air inlet for delivering air to the air and liquid mixing chamber; a liquid inlet line for delivering the cleaning composition from the container to the air and liquid mixing chamber; and an outlet line for delivering a mixture of air and liquid from the air and liquid mixing chamber outside of the mechanical foaming head.

A method for foaming a cleaning composition is provided according to the invention. The method includes steps of mixing a cleaning composition and air in a mechanical foaming head to provide mixing of the cleaning composition and air to generate a foam.

DETAILED DESCRIPTION OF THE INVENTION

The cleaning composition can be referred to as a detergent composition and can be provided in the form of a concentrated detergent composition, a ready-to-use detergent composition, and/or a detergent use composition. The phrase "cleaning composition" refers to a composition that provides for the removal of a substance from a surface to be cleaned. Exemplary substances that can be removed by the cleaning composition include soil, dirt, oil, grease, bacteria, microbes, viruses, etc.

The concentrated detergent composition can be referred to as the concentrate, and can be diluted to provide the ready-to-use detergent composition and/or the detergent use composition. The concentrate can be diluted in a single dilution or in stages to provide the ready-to-use detergent composition and/or the detergent use composition. Providing the cleaning composition as a concentrate for subsequent dilution can be advantageous when it is desirable to package and ship the concentrate instead of the ready-to-use detergent composition and/or the detergent use composition. The ready-to-use detergent composition can be made available as a use composition when the ready-to-use detergent composition is intended to be applied directly to a surface to provide cleaning. For example, a glass cleaner can be referred to as a ready-to-use detergent composition when it is intended to be applied directly to a glass surface for cleaning.

The cleaning composition according to the invention can be foamed and applied to a surface. In general, it is expected that the cleaning composition will provide cleaning in environments where application of a foam to a surface is advantageous. An exemplary environment where application of a foam to a surface is advantageous is where the foam provides for increasing contact time between the cleaning composition and the surface to be cleaned. By providing the cleaning composition in the form of a foam, the tendency of the cleaning composition to run or level when applied to a surface can be reduced. When cleaning a non-horizontal surface (such as a vertical surface), providing the cleaning composition in the form of a foam can enhance cling that allows the foam cleaning composition to remain in place and resist running off or down the non-horizontal surface as a result of gravity. Exemplary non-horizontal surfaces that are often cleaned include walls, doors, windows, and mirrors. In the case of horizontal surfaces, the foam cleaning composition can resist leveling.

This is advantageous in a situation, such as, cleaning a floor where it is desirable to have the foam cleaning composition remain in a specific location on the floor without running across the floor and/or running under a door.

When the cleaning composition is provided as a foam, the composition has a cellular structure that can be characterized as having several layers of air cells that provide the composition with a foamy appearance. It should be understood that the characterization of a foam refers to the existence of more than simply a few air bubbles. In general, a foam can be characterized as having at least 50 wt. % foam using a 15 second vertical separation test. The test is carried out by spraying the cleaning composition as a foam onto a vertical surface such as glass, waiting 15 seconds after application of the foam to the vertical surface, and then taking up the liquid portion and the foam portion in separate preweighted paper towels. The weight of the absorbed liquid can be calculated and the weight of the absorbed foam can be calculated. By providing a separation time of at least 15 seconds, it is believed that a reasonable amount of separation of liquid and foam can be achieved. The towel picking up the liquid portion should not pick up any of the foam portion, and the towel picking up the foam portion should not pick up the liquid portion that has fallen below the foam portion. It is understood that the foam portion may still include a small amount of associated liquid. However, this associated liquid is considered a part of the foam as long as it remains with the foam at the 15 second cut off time. The weight percent foam can be calculated by dividing the weight of the foam component by the total weight and multiplying by 100. The 15 second vertical separation test can be referred to as a "gravimetric foam test after 15 seconds." The cleaning composition preferably provides at least 70 wt. % foam according to the gravimetric foam test after 15 seconds, more preferably at least about 90 wt. % foam, and even more preferably at least about 95 wt. % foam. In general, it is desirable to have the foam hang up and not fall down a vertical surface to provide desired contact time and to allow a person sufficient time to work the foam at its intended location. The period of 15 seconds is selected for the test because it is expected that a foam will likely "hang" for at least about 15 seconds and any free liquid, if present at all, will have an opportunity to separate from the foam and fall down the vertical surface. In addition, the foam persists for at least about 15 seconds after application to a surface. This means that the foam will have a tendency to remain as a foam and will resist condensing to a liquid in order to provide the above-identified weight percent foam. More preferably, the foam persists for at least about 1 minute after application to the surface.

The cleaning composition can be formulated for various types of cleaning applications where delivery as a foam is advantageous. Exemplary applications where delivery as a foam is advantageous include hard surface cleaning compositions, hard surface antimicrobial compositions, toilet bowl cleaning compositions, carpet cleaning composition, glass cleaning composition, skin care products, floor strippers, floor finishes, presoaks, detergents, wheel cleaners, tire dressings, polishes, and pesticides. When used as an antimicrobial formulation, the composition can be used on hard surfaces, meats, vegetables, fabrics, and skin. When used as a hard surface cleaner, the composition can be applied to stainless steel, aluminum, copper, vinyl, plastic, metal, glass, rubber (natural and synthetic), formica, wood, mild steel, melamine, brass, ceramic, stone, etc. In addition, the composition can be advantageously used on nonhorizontal surfaces including those surfaces found on toilets, glass, mirrors, showers, transportation vehicles, walls, etc. Exemplary fabrics on which the composition can be used include wovens, nonwovens, knits, etc., and can be used as a prespotter for laundry and carpets. Exemplary skin care products that can be provided include soaps, lotions, etc. Exemplary carpet/textile cleaners that can be provided include spotters, bleaches, rust removers, softeners, and detergents. When provided as a floor stripper, the composition can maintain its position on the floor rather than leveling and, for example, running under a door. When the composition is provided as a polish, it can be applied to appliances and other devices such as refrigerators, stoves, dishwashers, elevators, doors, faucets, countertops, sinks, etc. When provided as a pesticide, the composition can be foamed to fill difficult to access areas and non-horizontal surfaces.

The composition according to the invention can be foamed without the use of a propellant, and applied as a foam directly to a surface. A solvent can assist in the generation of a foam when the composition is processed through a mechanical foaming head. The solvents that assist in the generation of a foam can be referred to as "foam-boosting solvents." Mechanical foaming heads that can be used according to the invention to provide foam generation include those heads that cause air and the cleaning composition to mix and create a foamed composition. That is, the mechanical foaming head causes air and the cleaning composition to mix in a mixing chamber and then pass through an opening to create a foam.

The cleaning composition according to the invention can be foamed without the use of a propellant normally associated with aerosol compositions. In general, aerosol compositions include a pressurized container for storing a composition and a propellant. The expansion of the propellant in the composition and propellant mixture as it passes through a nozzle causes the cleaning composition to become foamed. The mechanical foaming head utilized according to the invention, in contrast, relies upon air from the environment and causes the air to mix with the liquid composition to become foamed. While it is understood that operating the mechanical foaming head may result in a compression of the air within the mixing chamber, it is pointed out that the container that stores the cleaning composition is not considered pressurized even though the pressure inside the container may be slightly higher or lower than ambient pressure at times. Propellants that are often used in aerosols include liquids that form gases when expanded to atmospheric pressure. Exemplary propellants commonly used in aerosols include fluorocarbons, chlorofluorocarbons, and alkanes such as butane, ethane, isobutane, and propane. Propellants in general and these propellants in particular can be excluded from the cleaning composition according to the invention or they can be limited to an amount, if any are present, that is insufficient to provide foaming of the composition as a result of pressure drop (such as through an aerosol nozzle) so that the composition contains at least 50 wt. % foam according to a 15 second vertical separation test. Air has a tendency not to compress to a liquid under conditions normally encountered in conventional aerosol devices. Air is not considered a propellant according to the present invention even though it may be slightly compressed using the mechanical foaming head according to the invention. The term "propellant" as used herein should be understood to not refer to air and can be characterized as non-air containing propellants. The foam according to the invention can be characterized as having been formed by air rather than by a propellant. Because propellants are typically provided in a liquid form in combination with a liquid to be foamed, and form bubbles in the liquid as the propellant vaporizes as pressure drops, it is expected that the foam that is foamed by a propellant will contain residual propellant. It is believed that the residual propellant can be measured by a gas chromatographic head space analysis. It is expected that foams produced using a propellant will exhibit a concentration of propellant in the foam of greater than 1 ppm. Accordingly, the foam according to the invention includes less than 1 ppm propellant as measured by a gas chromatographic head space analysis. Preferably, the foam according to the invention has no propellant. That is, the foam according to the invention can be produced using air and need not be produced using a propellant.

Because the foam according to the invention can be prepared without a propellant, the container that holds the liquid cleaning composition can be constructed so that that it is capable of holding the cleaning composition under substantially atmospheric conditions both inside and outside the container. Because propellants are not used, the container need not be a container capable of withstanding the pressures normally associated with aerosol containers. Accordingly, the container can be provided from a plastic or polymer material rather than from a metallic material normally associated with aerosol containers.

Exemplary mechanical foaming heads that can be used according to the invention include those available from Airspray International, Inc. of Pompano Beach, Fla., and from Zeller Plastik, a division of Crown Cork and Seal Co. Exemplary mechanical foaming heads that can be used according to the invention are described in, for example, U.S. Pat. No. D-452,822; U.S. Pat. No. D-452,653; U.S. Pat. No. D-456,260; and U.S. Pat. No. 6,053,364. Mechanical foaming heads that can be used according to the invention include those heads that are actuated or intended to be actuated by application of finger pressure to a trigger that causes the cleaning composition and air to mix and create a foam. That is, a person's finger pressure can cause the trigger to depress thereby drawing the cleaning composition and air into the head and causing the cleaning composition and air to mix and create a foam.

Now referring to FIG. 1, a foam dispenser according to the present invention is shown at reference number 10. The foam dispenser 10 includes a container 12 holding a liquid cleaning composition 14, and a mechanical foaming head 16 attached to the container 12. The mechanical foaming head 16 includes a liquid inlet line 18 which draws the liquid cleaning composition 14 into the mechanical foaming head 16. In addition, an air inlet 20 draws air into the mechanical foaming head 16. The air inlet 20 for the foam dispenser 10 is provided within the container 12. That is, air 22 located within the container 12 is drawn in through the air inlet 20. It is understood that the mechanical foaming head 16 provides for venting of the air 22. The air 22 from the air inlet 20 and the liquid cleaning composition 14 from the liquid inlet line 18 combine in a mixing chamber 24 and then are forced through an outlet 26 to outside of the foam dispenser 10. The resulting foam can be applied to various surfaces. The mixing chamber 24 and the outlet 26 can be considered a part of the mechanical foaming head 16.

The foam dispenser 10 can be operated by depressing the trigger 30 using, for example, finger pressure or finger actuation. The operator can press the trigger 30 causing liquid and air to flow into the mixing chamber 24 and out the outlet 26. It is believe that intense mixing occurs within the mixing chamber 24. When the trigger 30 is released, it is understood that air is allowed to flow into the headspace 28 from outside the foam dispenser 10. It should be understood that although the air 22 provided within the headspace 28 can be used for mixing with the liquid cleaning composition 14 inside the mixing chamber 24, it should be understood that the container 12 can be designed so that air is drawn from outside of the container 12 rather than from the headspace 28. In addition, various techniques can be used to vent the headspace 28.

Figure 2:
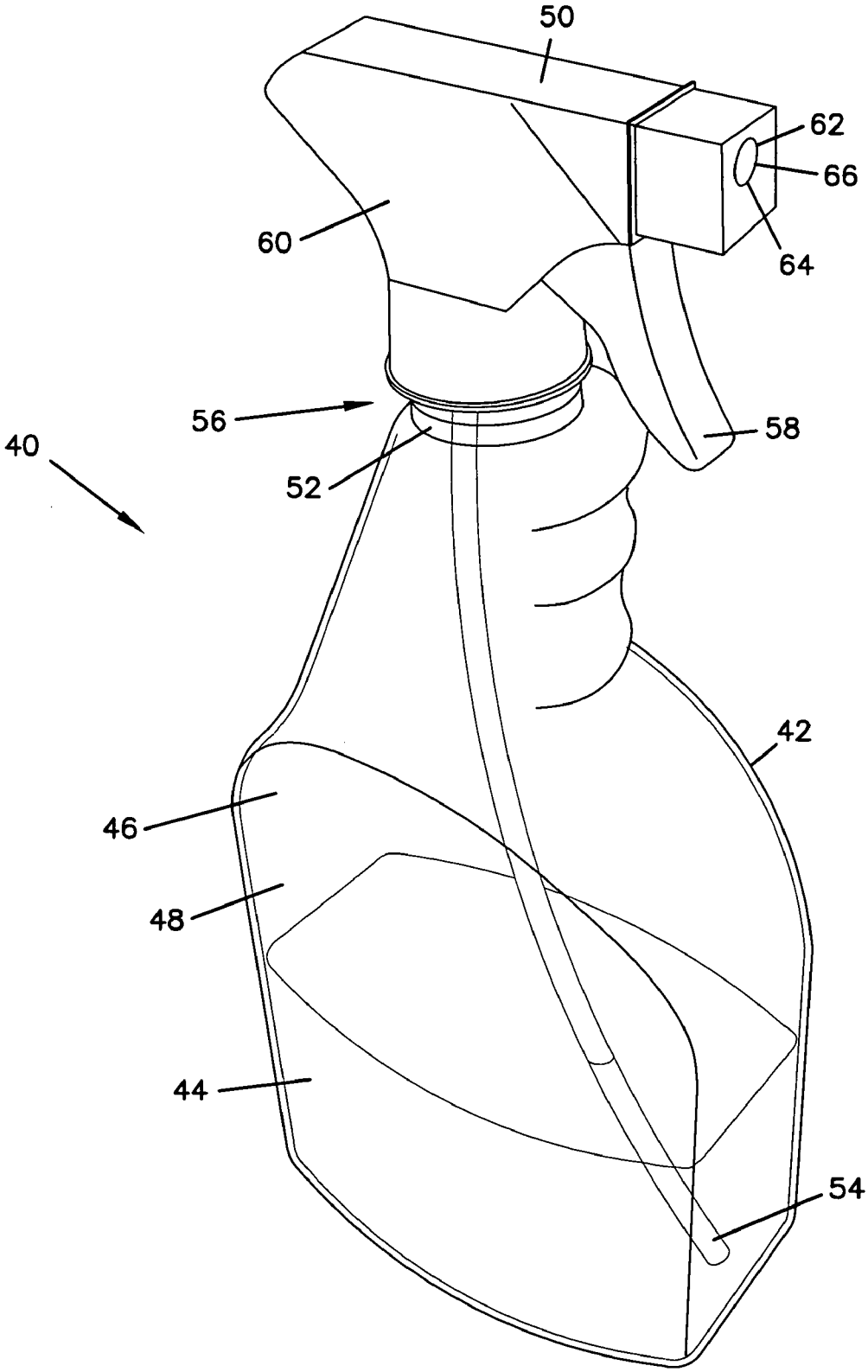
FIG. 2 is a perspective view of a foam dispenser according to the principles of the invention.

Now referring to FIG. 2, a foam dispenser according to the present invention is shown at reference number 40. The foam dispenser 40 includes a container 42 holding a liquid 44. In addition air 46 is provided in a headspace 48. The foam dispenser 10 additionally includes a mechanical foaming head 50 attached to the container 42 at the container neck 52. A liquid inlet line 54 draws liquid 44 into the mechanical foaming head 50. In addition, an air inlet 56 draws air into the mechanical foaming head 50. When the trigger 58 of the mechanical foaming head 50 is depressed, liquid and air flow into the mechanical foaming head 50 into a liquid and air mixing chamber 60, and through an outlet 62 to outside of the foam dispenser 10. The outlet 62 can include a foam generating opening 64 that assists in the generation of a foam when the combination of the air and the liquid pass therethrough. The foam generating opening 64 can include a foam generating structure such as a screen 66. In general, the foam generating structure 64 can be any structure that creates turbulence and/or enhancing mixing of air and liquid to generate foaming. For example, the foam generating structure can include obstructions or projections into the path through which the air and the liquid pass. Exemplary foam generating structures include narrow orifices, tubes, etc. It is expected that the foam dispenser 10 utilizes less intense mixing in the mixing chamber 60 compared with the level of mixing obtained in the mixing chamber 24 of the foam dispenser 10 (FIG. 1). As a result, the foam generating structure 64 can be provided to enhance contact between the liquid and the air to generate foaming.

It is expected that many compositions that contain a relatively large concentration of surfactant can be foamed when processed through a mechanical foaming head. When the concentration of surfactant is relatively low, it is often difficult to obtain sufficient foaming using a mechanical foaming head. It should be understood that sufficient foaming generally refers to the existence of a foam that provides a desired hang time or contact time when applied to a non-horizontal surface or that resists running or leveling for a desired length of time when placed on a horizontal surface. In the situation where the concentration of surfactant is relatively low, a foam-boosting solvent can assist in the generation of a desired foam when processed through a mechanical foaming head. While the theory explaining why a foam-boosting solvent assists in the generation of foam is not fully understood, it is believed that a possible explanation is that the foam-boosting solvent modifies the interaction of surfactant and water at the air and water interface in a manner that creates foaming whereas such modification may not occur to an extent that results in foaming when the foam-boosting solvent is not present.

A cylinder foam test has been used in the surfactant industry to evaluate the foamability of test compositions. In general, a cylinder foam test can be carried out by charging a test composition into a stoppered, graduated cylinder so that the charge composition occupies about ⅓ to about ½ of the height of the stoppered, graduated cylinder. The stoppered, graduated cylinder can be inverted about 10 times and the height of foam generated can be recorded. As reported in Examples 1-4, the cylinder foam test does not accurately predict whether a composition will foam when processed through a mechanical foaming head. That is, compositions that show a high level of foaming when tested using the cylinder foam test may generate little or no foaming when processed through a mechanical foaming head. In addition, compositions that may or may not generate a large amount of foaming during a cylinder foam test and that do not generate foaming when processed through a mechanical foaming head may, nevertheless, generate foaming when a foam-boosting solvent is added and the composition is processed through a mechanical foaming head.

Not all solvents will necessarily function as foam-boosting solvents to cause a composition to foam when processed through a mechanical foaming head. Certain types of solvents that have been found to function as foam-boosting solvents can be characterized in several ways. For example, foam-boosting solvents that have assisted in the generation of a foam when a composition is processed through a mechanical foaming head can be characterized as having an HLB (hydrophilic-lipophilic balance) value of at least about 6.9 and an OHLB (organic hydrophilic-lipophilic balance) value of between about 12 and about 20. HLB is a measure of water miscibility with values of 7.3 or greater corresponding to complete water solubility. OHLB values refer to the partitioning ability between water and organic phase with higher OHLB values corresponding to a greater tendency to partition into the organic phase. HLB values and OHLB values for solvents are readily available for most solvents. Exemplary foam-boosting solvents that can be used according to the invention can also be characterized as having a vapor pressure at room temperature of less than about 5 mmHg. The vapor pressure at room temperature can be less than about 1 mmHg, and can be less than about 0.1 mmHg. In addition, it may be desirable to provide the foam-boosting solvent as one characterized as GRAS (generally recognized as safe) by the FDA for direct or indirect food additives.

Exemplary foam-boosting solvents include glycols, glycol ethers, derivatives of glycol ethers, and mixtures thereof. Exemplary glycols include those having at least four carbon atoms such as hexylene glycol. Exemplary glycol ethers include alkylene glycol ethers and aromatic glycol ethers. Exemplary glycol ethers include those having the formula:

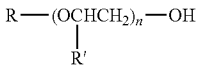

wherein R is a $C_1$-$C_6$ aliphatic or aromatic group, R' is H, $CH_3$, or $C_2H_5$, and n has a value of at least 1. The value of n can be between about 1 and about 4, and can be between about 1 and about 3. An exemplary glycol ether includes dipropylene glycol methyl ether wherein R is $CH_3$, R' is $CH_3$, and n has a value of 2. Another exemplary glycol ether is diethylene glycol butyl ether (sometimes referred to as butyl carbitol) wherein R is $C_4H_9$, R' is H, and n has a value of 2. An exemplary aromatic glycol ether is ethylene glycol phenyl ether where R is a phenyl group, R' is H, and n is a value of 1. Other exemplary glycol ethers include $C_1$-$C_6$ alkylene glycol ethers such as propylene glycol butyl ether, dipropylene glycol propyl ether, ethylene glycol butyl ether, diethylene glycol propyl ether, and triethylene glycol methyl ether. Exemplary glycol ethers are commercially available under the name Dowanol® from the Dow Chemical Company. For example, n-propoxypropanol is available under the name Dowanol PnP. Exemplary derivatives of glycol ethers include those glycol ethers modified to include an additional group or functionality such as an ester group. Exemplary derivatives of glycol ethers include those having the following formula:

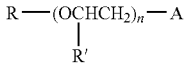

wherein R is a $C_1$-$C_6$ aliphatic or aromatic group, R' is H, $CH_3$, or $C_2H_5$, n has a value of at least 1, and A is an ester, amide, or ether group. The value of n can be between about 1 and about 4, and can be between about 1 and about 3. An exemplary derivative of a glycol ether includes propylene glycol methyl ether acetate. It should be understood that certain glycol ethers and derivatives such as ethylene glycol phenyl ether can be used with additional solvents for coupling.

The composition can include an amount of the foam-boosting solvent to provide a desired foam when processed through a mechanical foaming head. It has been found that the amount of foam-boosting solvent that can be provided to assist in the generation of a foam can be provided in an amount that does not significantly decrease the viscosity of the composition prior to foaming. That is, the amount of the foam-boosting solvent can be provided so that the composition that includes the foam-boosting solvent has a viscosity that is within about 50 centipoise of an otherwise identical composition except not including the foam-boosting solvent when the viscosity is measured on a Brookfield viscometer, model DV-E, at 22° C. a spindle speed of 100 rpm and a number 4 spindle, or at a spindle and speed that provides for measurement of viscosity. It is expected that the foam-boosting solvent will be present in the composition in an amount of at least about 0.1 wt. %, and can be included in an amount up to about 5 wt. %. An exemplary range of foam-boosting solvent in the composition is between about 0.5 wt. % and about 3 wt. %. Another exemplary range of the foam-boosting solvent is between about 1 wt. % and about 2 wt. %.

It is believed that the foam-boosting solvent can be provided in a composition containing a relatively low concentration of surfactant to help assist in the generation of a foam when processed through a mechanical foaming head. The amount of the foam-boosting solvent can be provided based upon the amount of total surfactant in the composition. For example, when the total amount of surfactant is relatively low, it is desirable to provide enough foam-boosting solvent so that the composition generates a foam when processed through a mechanical foaming head. An exemplary low concentration of total surfactant is about 0.05 wt. %. It is expected that at total surfactant concentrations of about 0.05 wt. % to about 10 wt. %, the foam-boosting solvent can be provided at a concentration of about 0.1 wt. % to about 5 wt. %, a concentration of between about 0.5 wt. % and about 3 wt. %, and a concentration of between about 1 wt. % and about 2 wt. %. In addition, the amount of foam-boosting solvent can be characterized as a weight ratio of the foam-boosting solvent to total surfactant in the composition. The weight ratio of foam-boosting solvent to total surfactant in the composition can be at least about 1:100 and can be up to about 100:1. The ratio of the foam-boosting solvent to total surfactant in the composition can be between about 1:40 and about 40:1, and can be between about 0.5:1 and about 20:1. In general, it is expected that as the concentration of surfactant increases, there may be less need for the foam-boosting solvent in order to obtain the desired level of foaming. In addition, for compositions that contain a total surfactant concentration in excess of 10 wt. %, it is expected that the composition can be designed so that it generates foaming without the use of a foam-boosting solvent. However, it is expected that in certain compositions that may even contain in excess of 10 wt. % total surfactant, a foam-boosting solvent may be used to enhance foaming. It should be understood that the weight percent surfactant as used herein refers to the weight percent based on a surfactant composition that is 100 percent active (i.e. not containing water). It should be understood that the surfactant composition can contain water but the measurement of the amount is based upon a 100 percent active composition.

The composition can be provided for a variety of applications. Tables 1-5are provided showing various compositional ranges for compositions that can be characterized as hard surface antimicrobial compositions, hard surface cleaning compositions, toilet bowl cleaning compositions, carpet cleaning compositions, and glass cleaning compositions. It should be understood that particular compositions can be provided within any of the ranges identified, and the compositions may include components other than those disclosed in the tables. In addition, it should be understood that the foam-boosting solvent can be provided in the previously described ranges, and the amount of foam-boosting solvent can be selected based upon the amount of the total surfactant as described previously. In addition, the organic solvent component identified in Table 5 refers to an organic solvent other than the foam-boosting solvent. For example, a glass cleaning composition may include organic solvent to promote the rate of drying.

TABLE 1

Hard Surface Antimicrobial Composition

| | Wt. % | Wt. % | Wt. % |
|---|---|---|---|
| antimicrobial agent | 0.1–95 | 1–50 | 5–30 |
| nonionic, anionic and/or amphoteric surfactant | 0–35 | 0.1–20 | 1–10 |
| builder/sequestrant | 0–75 | 1–40 | 5–25 |
| pH modifier | 0–20 | 0.1–10 | 0.5–5 |
| anti-redeposition agent | 0–10 | 0.1–5 | 0.5–3 |
| aesthetic aid | 0–10 | 0.1–3 | 0.5–2 |
| water | 0–99.9 | 20–90 | 25–80 |

TABLE 2

Hard Surface Cleaning Composition

| | Wt. % | Wt. % | Wt. % |
|---|---|---|---|
| nonionic, anionic and/or amphoteric surfactant | 0.1–95 | 1–80 | 5–50 |
| builder/sequestrant | 0–80 | 1–40 | 5–25 |
| pH modifier | 0–80 | 0.1–60 | 0.5–25 |
| anti-redeposition agent | 0–10 | 0.1–5 | 0.5–3 |
| aesthetic aid | 0–10 | 0.1–3 | 0.5–3 |
| water | 0–99.9 | 20–90 | 25–80 |

TABLE 3

Toilet Bowl Cleaning Composition

| | Wt. % | Wt. % | Wt. % |
|---|---|---|---|
| nonionic, anionic and/or amphoteric surfactant | 0.1–95 | 1–30 | 2–20 |
| builder/sequestrant | 0–80 | 1–40 | 5–25 |
| pH modifier | 0–80 | 0.1–60 | 5–20 |
| anti-redeposition agent | 0–10 | 0.1–5 | 0.5–3 |

TABLE 3-continued

Toilet Bowl Cleaning Composition

| | Wt. % | Wt. % | Wt. % |
|---|---|---|---|
| aesthetic aid | 0–10 | 0.1–3 | 0.5–2 |
| water | 0–99.9 | 20–90 | 25.80 |

TABLE 4

Carpet Cleaning Composition

| | Wt. % | Wt. % | Wt. % |
|---|---|---|---|
| nonionic, anionic and/or amphoteric surfactant | 0.1–95 | 1–30 | 2–20 |
| builder/sequestrant | 0–80 | 1–40 | 5–25 |
| pH modifier | 0–80 | 0.1–60 | 5–20 |
| anti-redeposition agent | 0–10 | 0.1–5 | 0.5–3 |
| viscosity modifier | 0–10 | 0.1–5 | 0.5–3 |
| water | 0–99.9 | 20–90 | 25–80 |

TABLE 5

Glass Cleaning Composition

| Component | 1st Range (wt. %) | 2nd Range (wt. %) | 3rd Range (wt. %) |
|---|---|---|---|
| water | 0.1–99 | 30–90 | 60–89 |
| anionic surfactant | 0.1–10 | 0.2–5 | 0.5–1.5 |
| dispersant | 0.01–10 | 0.2–5 | 0.5–1.5 |
| sheeting agent and/or humectant | 0.001–10 | 0.05–1 | 0.06–0.5 |
| organic solvent | 0.1–99 | 5–50 | 10–30 |

Exemplary components that can be included in the exemplary compositions shown in Tables 1-5 are described below. It should be understood that the various exemplary components may be more useful in one type of composition than another.

Surfactant

A surfactant or surfactant mixture can be included in the detergent composition. Exemplary types of surfactants that can be included include anionic surfactants, cationic surfactants, nonionic surfactants, and zwitterionic or amphoteric surfactants.

The anionic surfactant component can include a detersive amount of an anionic surfactant or a mixture of anionic surfactants. Anionic surfactants are often desirable in cleaning compositions because of their wetting and detersive properties. The anionic surfactants that can be used according to the invention include any anionic surfactant available in the cleaning industry. Exemplary groups of anionic surfactants include carboxylates, isethionates, sulfonates and sulfates. Exemplary surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Exemplary alkyl aryl sulfonates that can be used in the cleaning composition can have an alkyl group that contains 6 to 24 carbon atoms and the aryl group can be at least one of benzene, toluene, and xylene. An exemplary alkyl aryl sulfonate includes linear alkyl benzene sulfonate. An exemplary linear alkyl benzene sulfonate includes linear dodecyl benzyl sulfonate that can be provided as an acid that is neutralized to form the sulfonate. Additional exemplary alkyl aryl sulfonates include xylene sulfonate and cumene sulfonate.

Exemplary alkane sulfonates that can be used in the cleaning composition can have an alkane group having 6 to 24 carbon atoms. Exemplary alkane sulfonates that can be used include secondary alkane sulfonates. An exemplary secondary alkane sulfonate includes sodium $C_{14}$-$C_{17}$ secondary alkyl sulfonate commercially available as Hostapur SAS from Clariant.

Exemplary alkyl methyl ester sulfonates that can be used in the cleaning composition include those having an alkyl group containing 6 to 24 carbon atoms.

Exemplary alpha olefin sulfonates that can be used in the cleaning composition include those having alpha olefin groups containing 6 to 24 carbon atoms.

Exemplary alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An exemplary alkoxy group is ethoxy. An exemplary alkyl ether sulfate is sodium lauryl ether ethoxylate sulfate and is available under the name Steol CS-460.

Exemplary alkyl sulfates that can be used in the cleaning composition include those having an alkyl group containing 6 to 24 carbon atoms. Exemplary alkyl sulfates include sodium lauryl sulfate and sodium lauryl/myristyl sulfate.

The anionic surfactant can be neutralized with an alkaline metal salt, an amine, or a mixture thereof. Exemplary alkaline metal salts include sodium, potassium, and magnesium. Exemplary amines include monoethanolamine, triethanolamine, and monoisopropanolamine. If a mixture of salts is used, an exemplary mixture of alkaline metal salt can be sodium and magnesium, and the molar ratio of sodium to magnesium can be between about 3:1 and about 1:1.

Exemplary amphoteric surfactants include betaines, amine oxides, sultaines, amphoacetates, imidazoline derivatives, and mixtures thereof.

The zwitterionic surfactants that can be used according to the invention include β-N-alkylaminopropionates, N-alkyl-β-iminodipropionates, imidazoline carboxylates, N-alkylbetaines, sulfobetaines, sultaines, amine oxides and polybetaine polysiloxanes. Exemplary polybetaine polysiloxanes have the formula:

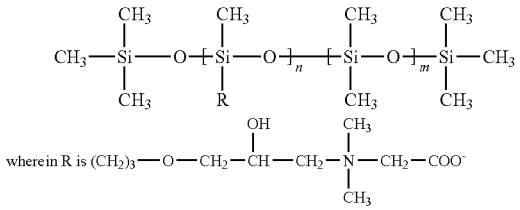

n is 1 to 100 and m is 0 to 100, preferably 1 to 100. Preferred polybetaine polysiloxanes are available under the name ABIL® from Goldschmidt Chemical Corp. Preferred amine oxides that can be used include alkyl dimethyl amine oxides containing alkyl groups containing 6 to 24 carbon atoms. An exemplary amine oxide is lauryl dimethylamine oxide.

Exemplary nonionic surfactants include alcohol alkoxylates, ethylene oxide-propylene oxide copolymers, alkyl polyglycosides, alkanolamides, and mixtures thereof.

Exemplary nonionic surfactants include nonionic block copolymers, alcohol alkoxylates, alkyl polyglycosides, alkanolamides, and mixtures thereof. Exemplary alcohol alkoxylates include alcohol ethoxylates, alcohol propoxylates, alkyl phenol ethoxylate-propoxylates, and mixtures thereof.

Exemplary nonionic block copolymer surfactants include polyoxyethylene-polyoxypropylene block copolymers. Exemplary polyoxyethylene-polyoxypropylene block copolymers that can be used have the formulae:

$$(EO)_x(PO)_y(EO)_x$$

$$(PO)_y(EO)_x(PO)_y$$

$$(PO)_y(EO)_x(PO)_y(EO)_x(PO)_y$$

wherein EO represents an ethylene oxide group, PO represents a propylene oxide group, and x and y reflect the average molecular proportion of each alkylene oxide monomer in the overall block copolymer composition. Preferably, x is from about 10 to about 130, y is about 15 to about 70, and x plus y is about 25 to about 200. It should be understood that each x and y in a molecule can be different. The total polyoxyethylene component of the block copolymer is preferably at least about 20 mol-% of the block copolymer and more preferably at least about 30 mol-% of the block copolymer. The material preferably has a molecular weight greater than about 1,500 and more preferably greater than about 2,000. Although the exemplary polyoxyethylene-polyoxypropylene block copolymer structures provided above have 3 blocks and 5 blocks, it should be appreciated that the nonionic block copolymer surfactants according to the invention can include more or less than 3 and 5 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers. Exemplary sheeting agents that can be used according to the invention are available from BASF under the name Pluronic, and an exemplary EO-PO co-polymer that can be used according to the invention is available under the name Pluronic N3.

A desirable characteristic of the nonionic block copolymers is the cloud point of the material. The cloud point of nonionic surfactant of this class is defined as the temperature at which a 1 wt-% aqueous solution of the surfactant turns cloudy when it is heated. Nonionics tend to provide desired detersive properties at near their cloud point.

The alcohol alkoxylate surfactants that can be used according to the invention can have the formula:

$$R(AO)_x—X$$

wherein R is an alkyl group containing 6 to 24 carbon atoms, AO is an alkylene oxide group containing 2 to 12 carbon atoms, x is 1 to 20, and X is hydrogen or an alkyl or aryl group containing 1-12 carbon atoms. The alkylene oxide group is preferably ethylene oxide, propylene oxide, butylene oxide, or mixture thereof. In addition, the alkylene oxide group can include a decylene oxide group as a cap.

The alkyl polyglycoside surfactants that can be used according to the invention can have the formula:

$$(G)_x\text{-}O—R$$

wherein G is a moiety derived from reducing saccharide containing 5 or 6 carbon atoms, e.g., pentose or hexose, R is a fatty aliphatic group containing 6 to 24 carbon atoms, and x is the degree of polymerization (DP) of the polyglycoside representing the number of monosaccharide repeating units in the polyglycoside. The value of x can be between about 0.5 and about 10. R can contain 10-16 carbon atoms and x can be 0.5 to 3.

Alkanolamides that can be used as nonionic surfactants include alkanolamides having the following formula:

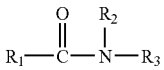

wherein $R_1$ is $C_6$-$C_{20}$ alkyl group, $R_2$ is hydrogen or a $C_1$-$C_3$, and $R_3$ is hydrogen or a $C_1$-$C_3$ alkyl group. An exemplary alkanolamide is available as cocodiethanolamide.

Exemplary cationic surfactants that can be used include quaternary ammonium compounds and amine salts including those having the following formula:

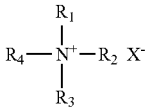

wherein $R_1$, $R_2$, $R_3$, and $R_4$ can, independently of each other, be hydrogen, $C_1$-$C_{24}$ branched, linear, alkyl, aryl, or aralkyl groups, and X can be an anion such as a halide, methosulfate, ethosulfate, carbonate, phosphate, sulfate, etc.

Builder/Sequestrant

The cleaning composition according to the invention can include complexing or chelating agents that aid in reducing the harmful effects of hardness components in service water. Typically, calcium, magnesium, iron, manganese, or other polyvalent metal cations, present in service water, can interfere with the action of cleaning compositions. A chelating agent can be provided for complexing with the metal cation and preventing the complexed metal cation from interfering with the action of an active component of the rinse agent. Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly comprise ionomer compositions such as polyacrylic acids compounds. Small molecule organic chelating agents include aminocarboxylates, polycarboxylates, and hydroxycarboxylates. Exemplary aminocarboxylates include ethylenediaminetetracetic acid (EDTA), and hydroxyethylenediaminetetracetic acid, nitrilotriacetic acid, ethylenediaminetetrapropionates, triethylenetetraminehexacetates, and salts thereof including alkali metal ammonium and substituted ammonium salts. Exemplary polycarboxylates include citric acid and citrate salt. Exemplary hydroxycarboxylates include hydroxyacetic acid, salicylic acid, and salts thereof.

Phosphonates are also suitable for use as chelating agents in the composition of the invention and include ethylenediamine tetra(methylenephosphonate), nitrilotrismethylenephosphonate, diethylenetriaminepenta(methylene phosphonate), hydroxyethylidene diphosphonate, and 2-phosphonobutane-1,2,4-tricarboxylic acid. Preferred chelating agents include the phosphonates amino-carboxylates. These phosphonates commonly contain alkyl or alkylene groups with less than 8 carbon atoms.

It should be understood that the concentrate can be provided without a component conventionally characterized as a builder, a chelating agent, or a sequestrant. Nevertheless, it is believed that these components can advantageously be incorporated into the cleaning composition. It is expected that their presence would not be provided in an amount sufficient to handle the hardness in the water resulting from the water of dilution mixing with the concentrate to form the use solution when the water of dilution is considered to be fairly hard water and the ratio of water of dilution to the concentrate is fairly high.

Exemplary builders/sequestering agents include ethylenediamine derivatives, ethylenetriamine derivatives, NTA, phosphates, organophosphonates, zeolites, hydroxyacids, their salts, and mixtures thereof.

pH Modifier

Exemplary pH modifiers include alkalinity sources and acidity sources. Exemplary alkalinity sources include inorganic bases (hydroxides, carbonates, bicarbonates, percarbonates, silicates, etc.) and organic bases (alkylamines, alkanolamines, etc.). Exemplary acidity sources include inorganic acids (bisulfates, phosphoric acid, hydrochloric acid, etc.) and organic acids (polycarboxyacids, hydroxycarboxylic acids, etc.).

It can be desirable to provide the use solution with a relatively neutral pH, alkaline pH, or acidic pH. In many situations, it is believed that the presence of hard water as water of dilution will cause the use solution to exhibit a neutral or alkaline pH. In order to ensure a relatively neutral pH, alkaline pH, or acidic pH a pH modifier can be incorporated into the concentrate. In general, the amount of pH modifier should be sufficient to provide the use solution with a pH in the desired range. Exemplary ranges include 1-6, 7-8, and 9-14.

The pH modifier can include an alkalinity source. The alkalinity source can be organic and/or inorganic. Exemplary alkaline buffering agents include alkanolamines. An exemplary alkaline alkanolamine organic pH modifier is beta-aminoalkanol and 2-amino-2-methyl-1-propanol(AMP).

Exemplary alkanolamines are beta-aminoalkanol compounds. They serve primarily as solvents when the pH is about 8.5, and especially above about 9.0. They also can provide alkaline buffering capacity during use. Exemplary beta-aminoalkanols are 2-amino-1-butanol; 2-amino-2-methyl-1-propanol; and mixtures thereof. Beta-aminoalkanol is 2-amino-2-methyl-1-propanol can be desirable because of its low molecular weight. The beta-aminoalkanols can have boiling points below about 175° C.

Other suitable alkalinity agents that can also be used include alkali metal hydroxides, i.e., sodium, potassium, etc., and carbonates or sodium bicarbonates. Water-soluble alkali metal carbonate and/or bicarbonate salts, such as sodium bicarbonate, potassium bicarbonate, potassium carbonate, cesium carbonate, sodium carbonate, and mixtures thereof, can be added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof.

Contrary to the teachings of U.S. Pat. No. 6,420,326, the concentrate can include a buffering capacity greater than the equivalent of 0.050 wt.% 2-amino-2-methyl-1-propanol without experiencing deleterious streaking as a glass cleaner composition. In addition, the concentrate can include a buffering capacity greater than the equivalent of 0.070 wt. % of 2-amino-2-methyl-1-propanol, and greater than the equivalent of 0.1 wt. % of 2-amino-2-methyl-1-propanol.

Exemplary inorganic acids include phosphoric acid, hydrochloric acid, nitric acid, sulfuric acid, sulfamic acid, mixtures thereof, or the like. Exemplary organic acids include lactic acid, citric acid, propionic acid, acetic acid, hydroxyacetic acid, formic acid, glutaric acid, maleic acid, hydroxy propionic acid, succinic acid, glutaric acid, adipic acid, fumaric acid, mixtures thereof, or the like. The organic acid can be a mixture of adipic, maleic, and succinic acids sold under the trade name Sokalan. In an embodiment, the acid can include phosphoric acid, lactic acid, or a mixture thereof. In an embodiment, the acid can include phosphoric acid, lactic acid, hydroxyacetic acid, or a mixture thereof. In an embodiment, the acid includes citric acid, lactic acid, urea hydrochloride, or a mixture thereof.

Anti-Redeposition Agent

Exemplary anti-redeposition agents that can be used include carboxycellulose derivatives, acrylate polymers and copolymers, and mixtures thereof.

Aesthetic Aid

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Pylaklor Pink LX-10613, and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Exemplary other aesthetic aids include UV inhibitors.

Antimicrobial Agents

Exemplary antimicrobial agents that can be used include quaternary ammonium compounds, active halogen compounds, phenolic derivatives, peroxy compounds, and mixtures thereof.

Solvents

Solvents other than foam-boosting solvents can be included in the composition to provide the composition with desired properties. For example, certain solvents can be included in an amount to provide the desired cleaning and evaporative properties. In general, the amount of solvent should be limited so that the use solution is in compliance with volatile organic compound (VOC) regulations for a particular class of cleaner. In addition, it should be understood that the organic solvent is an optional component and need not be incorporated into the concentrate or the use solution according to the invention. When the organic solvent is included in the concentrate, it can be provided in an amount of between about 0.1 wt. % and about 99 wt. %, between about 5 wt. % and about 50 wt. %, and between about 10 wt. % and about 30 wt. %.

Additional ingredients that may or may not be included in any of the compositions include organic solvents such as glycols, glycol ethers, mineral spirits, oils, etc.; soil release additives such as fluorinated polymers, silanes, and derivatives of fluorinated polymers and silanes, etc.; anti-static additives such as quaternary ammonium compounds, humectants, etc.; sheeting agents such as ethyleneoxide-propyleneoxide copolymers, humectants, amphoteric surfactants, etc.

The composition, when provided as a glass cleaning composition, can include the components identified in U.S. application Ser. No. 10/723,455 that was filed with the United States Patent and Trademark Office on Nov. 25, 2003, the entire disclosure of which is incorporated herein by reference. The glass cleaner composition disclosed in U.S. application Ser. No. 10/723,455 is formulated to handle high solids containing water that can be added to dilute a concentrate to form a ready-to-use composition.

Water

The concentrate can be diluted with water to provide the ready-to-use composition and/or the use composition. In general, it is expected that the concentrate will be diluted with water at a weight ratio of at least about 1:1. In addition, it is expected that the dilution of the concentrate with water will be less than about 1:600. It is understood that a weight ratio of about 1:600 is slightly less than a dilution of about ¼ ounce concentrate to about 1 gallon of water. It is expected that the ready-to-use composition or the use composition will contain at least about 80 wt. % water. In addition, it is expected that the ready-to-use composition and/or the use composition will include at least about 90 wt. % water, preferably at least about 95 wt. % water, and more preferably at least about 96 wt. % water.

By providing the cleaning composition as a concentrate, it is expected that the concentrate will be diluted with the water available at the locale or site of dilution. It is recognized that the level of water hardness changes from one locale to another. Accordingly, it is expected that that concentrate will be diluted with water having varying amounts of hardness depending upon the locale or site of dilution. In general, water hardness refers to the presence of calcium, magnesium, iron, manganese, and other polyvalent metal cations that may be present in the water, and it is understood that the level of water hardness varies from municipality to municipality. The concentrated detergent composition is formulated to handle differing water hardness levels found in varying locations without having to soften the water or remove the hardness from the water. High solids containing water is considered to be water having a total dissolved solids (TDS) content in excess of 200 ppm. In certain localities, the service water contains a total dissolved solids content in excess of 400 ppm, and even in excess of 800 ppm. Water hardness can be characterized by the unit "grain" where one grain water hardness is equivalent to 17.1 ppm hardness expressed as $CaCO_3$. Hard water is characterized as having at least 1 grain hardness. Water is commonly available having at least 5 grains hardness, at least 10 grains hardness, and at least 20 grains hardness.

Hardness Anti-Precipitant

The hardness in water can cause anionic surfactants to precipitate. Visual precipitation refers to precipitate formation that can be observed by the naked eye without visual magnification or enhancement. In order to protect the anionic surfactant component in the cleaning composition of the invention, a water hardness anti-precipitant mixture is provided that includes a dispersant and at least one of a sheeting agent and a humectant. The cleaning composition can include additional surfactants and other components commonly found in cleaning compositions.

The water hardness anti-precipitant includes a mixture of a dispersant and at least one of a sheeting agent and a humectant. The combination of the dispersant and the at least one of a sheeting agent and a humectant provides the use solution with resistance to precipitation of the anionic surfactant component caused by hardness in the water. In addition, it is believed that the combination of the dispersant and the sheeting agent and/or the humectant can provide stability from precipitation at temperatures down to about 40° F., and at temperatures down to freezing. The dispersant and the sheeting agent and/or the dispersant are believed to act synergistically to provide protection against precipitation of anionic surfactants in the presence of hard water.

The dispersant is a component that is conventionally added to cleaning compositions to handle the hardness found in water. Dispersants that can be used according to the invention include those that are referred to as "lime soap dispersants." In general, it is understood that dispersants have a tendency to interfere with precipitation of anionic surfactants caused by water hardness.

Dispersants that can be used according to the invention can include a polymer and/or an oligomer containing pendant carboxylic acid groups and/or pendant carboxylic acid salt groups. It should be understood that the term "pendant" refers to the groups being present other than in the polymer backbone and/or oligomer backbone. The dispersants can be available as homopolymers or co-polymers or as homoligomers or co-oligomers. Exemplary dispersants include poly(acrylic acid), poly (acrylic acid/maleic acid) co-polymers, poly(maleic acid/olefin) co-polymers, phosphino carboxylated polymers, and mixtures thereof. The dispersants can be soluble or dispersible in the concentrate and can be a component that does not significantly increase the viscosity of the concentrate or of the use solution relative to its absence. The dispersant can be a homopolymer or co-polymer, and can have a molecular weight range of about 300 to about 5,000,000, and can have a molecular weight range of about 2,000 to about 2,000,000, and can have a molecular weight range of about 3,000, to about 500,000. The dispersant can include repeating units based upon acrylic acid, maleic acid, polyols, olefins, and mixtures thereof. An exemplary dispersant is a maleic anhydride/olefin co-polymer. An exemplary maleic anhydride/olefin co-polymer is available from Rohm & Haas under the name of Acusol 460N. An exemplary polyacrylic acid sodium salt having a molecular weight of about 4,500 is available from Rohm & Haas under the name Acusol 434N. An exemplary acrylic acid/maleic acid co-polymer having a molecular weight of about 3,200 is available from Rohm & Haas under the Acusol 448. An exemplary acrylic acid/maleic acid sodium salt having a molecular weight of about 70,000 is available from Rohm & Haas under the name Acusol 479N. An exemplary acrylic acid/maleic acid sodium salt having a molecular weight of about 40,000 is available from Rohm & Haas under the name Acusol 505N. In general, if the dispersant is provided as an acid, its pH may be adjusted to neutral or alkaline. The pH adjustment may be provided prior to forming the concentrate or during the formation of the concentrate. In addition, the pH adjustment may occur at any time prior to or during dilution with the water of dilution to provide the use solution. The dispersant can be provided in the concentrate in an amount sufficient, when taken in consideration of the amount of sheeting agent and/or humectant, to provide resistance to precipitation of the anionic surfactant component when diluted with hard water. In general, the concentrate can contain between about 0.01 wt. % and about 10 wt. % dispersant, between about 0.2 wt. % and about 5 wt. % dispersant, and between about 0.5 wt. % and about 1.5 wt. % dispersant.

Sheeting Agent and Humectant

The sheeting agent and/or humectant can be any component that provides a desired level of sheeting action and, when combined with the dispersant, creates a resistance to precipitation of the anionic surfactant component in the presence of hard water.

Exemplary sheeting agents that can be used according to the invention include surfactant including nonionic block copolymers, alcohol alkoxylates, alkyl polyglycosides, zwitterionics, anionics, and mixtures thereof. Additional exemplary sheeting agents include alcohol ethoxylates; alcohol propoxylates; alkylphenol ethoxylate-propoxylates; alkoxylated derivatives of carboxylic acids, amines, amids and esters; and ethylene oxide-propylene oxide copolymers. Exemplary ethylene oxide-propylene oxide polymers include those available under the name Pluronic, Pluronic R, Tetronic, and Tetronic R from BASF.

The anionic surfactants that can be used as sheeting agents according to the invention include sulfonic acid salts, phosphoric and polyphosphoric acid esters, perfluorinated anionics, and mixtures thereof. Exemplary sulfonic acid salts include cumene sulfonates, toluene sulfonates, xylene sulfonates, and sulfosuccinate esters.

Exemplary surfactants which can be used as sheeting agents according to the invention are disclosed in Rosen, Surfactants and Interfacial Phenomena, second edition, John Wiley & sons, 1989, the entire document being incorporated herein by reference. Humectants that can be used according to the invention include those substances that exhibit an affinity for water and help enhance the absorption of water onto a substrate. If the humectant is used in the absence of a sheeting agent, the humectant should be capable of cooperating with the dispersant to resist precipitation of the anionic surfactant in the presence of hard water. Exemplary humectants that can be used according to the invention include glycerine, propylene glycol, sorbitol, alkyl polyglycosides, polybetaine polysiloxanes, and mixtures thereof. The alkyl polyglycosides and polybetaine polysiloxanes that can be used as humectants include those described previously as sheeting agents.

When the humectant is incorporated into the cleaning composition, it can be used in an amount based upon the amount of sheeting agent used. In general, the weight ratio of humectant to sheeting agent can be greater than 1:3, and can be provided at between about 5:1 and about 1:3. It should be appreciated that the characterization of the weight ratio of humectant to sheeting agent indicates that the lowest amount of humectant to sheeting agent is 1:3, and that more humectant relative to the same amount of sheeting agent can be used. The weight ratio of humectant to sheeting agent can be between about 4:1 and about 1:2, and can be between about 3:1 and about 1:1. When using a humectant in the cleaning composition, it is preferable that the sheeting agent and the humectant are not the same chemical molecule. Although alkyl polyglycosides and polybetaine polysiloxanes are identified as both sheeting agents and humectants, it should be understood that the cleaning composition preferably does not have a particular alkyl polyglycoside functioning as both the sheeting agent and the humectant, and preferably does not have a specific polybetaine polysiloxane functioning as the sheeting agent and the humectant. It should be understood, however, that different alkyl polyglycosides and/or different polybetaine polysiloxanes can be used as sheeting agents and humectants in a particular cleaning composition.

It is understood that certain components that are characterized as humectants have been used in prior compositions as, for example, processing aids, hydrotropes, solvents, and auxiliary components. In those circumstances, it is believed that the component has not been used in an amount or an in environment that provides for reducing water solids filming in the presence of high solids containing water. The use of humectants in a rinse agent composition is described in U.S. application Ser. No. 09/606,290 that was filed with the United States Patent and Trademark Office on Jun. 29, 2000, the entire disclosure of which is incorporated herein by reference.

The concentrate can include an amount of sheeting agent and/or humectant that cooperates with the dispersant to resist precipitation of the anionic surfactant by hard water. The concentrate can contain between about 0.001 wt. % and about 10 wt. % of the sheeting agent and/or humectant, between about 0.05 wt. % and about 1 wt. % of the sheeting agent and/or humectant, and between about 0.06 wt. % and about 0.5 wt. % of the sheeting agent and/or humectant.

The amounts of dispersant and at least one of sheeting agent and humectant provided in the cleaning composition can be controlled to handle the water hardness levels expected from various localities as a result of the dilution of the concentrate to a use solution. In general, it is expected that the weight ratio of the dispersant to the total sheeting agent and/or humectant can be between about 1:75 to about 75:1, between about 1:30 to about 30:1, between about 1:25 to about 25:1, between about 1:15 and about 15:1; between about 1:10 and about 10:1, and between about 1:5 and about 5:1.

An exemplary glass cleaning composition that can be used according to the invention is provided in Table 6.

TABLE 6

| Component | Wt. % |
|---|---|
| deionized water | 98.4 |
| dispersant | 0.06 |
| foam-boosting solvent | 1.05 |
| pH modifier | 0.11 |
| anionic surfactant | 0.29 |
| sheeting agent | 0.006 |
| chelating agent | 0.06 |
| dye | 0.003 |
| fragrance | 0.006 |

An exemplary dispersing agent that can be used is a lime soap dispersing agent such as the sodium salt of polycarboxylate maleic anhydride/olefin copolymer and is available under the name Acusol 460.

An exemplary foam-boosting solvent that can be used is n-propoxypropanol available under the name Dowanol PnP.

The pH modifier can be monoethanolamine at an active level of 99%.

The anionic surfactant can be sodium lauryl sulfate at an active level of 30%.

The sheeting agent can be a propoxy-ethoxy copolymer such as the one available under the name Pluronic N-3.

The chelating agent can be tetrasodium EDTA at 40% and containing less than 1% NTA.

An exemplary dye is chromatint blue 0408.

EXAMPLES

In the following examples, products from a foaming head were evaluated for foam characteristics. The products were evaluated as not foaming (no foam), foaming reasonably well (flat foaming), and foaming very well (like shaving cream).

Example 1

Disinfectant Foam Boosting by Solvent Addition

A commercial disinfectant/cleaner available under the name Ascend from Ecolab was diluted with water at a weight ratio of 1:256. Butyl carbitol was added to test dispensability as a foam through a mechanical foaming head on an unpressurized bottle. As the data in Table 7 illustrates, without the addition of butyl carbitol the disinfectant use solution does not form a foam through a foamer head. Further, the data shows no correlation between the traditional Cylinder Foam Test and results obtained with a mechanical roamer head. In fact, the Cylinder Foam Test in the below instance actually shows a decrease in the foamability of the composition on the addition of solvent. A comparison of viscosities of the test systems shows that there is no apparent change in viscosity to explain the foam boosting effect of butyl carbitol.

TABLE 7

| Sample | Solvent Added | Cylinder Foam | Foamer Head | Viscosity |
|---|---|---|---|---|
| 1:256 Ascend | none | 46 mL | no foam | <50 cps |
| 1:256 Ascend | 2% butyl carbitol | 40 mL | like shaving cream | <50 cps |

Example 2

Effect of Solvent Type on Foam Boosting

A 1:256 dilution of a commercial disinfectant/cleaner available under the name Ascend from Ecolab Inc. was combined with various solvents to its dispensability as a foam through a mechanical foamer head on an unpressurized bottle. As the data in Table 8 illustrates, without the addition of select solvents the disinfectant use solution does not form a foam through a foamer head. Further, the data shows no correlation between the traditional Cylinder Foam Test and results obtained with a mechanical foamer head.

TABLE 8

| Sample | Solvent Added | Cylinder Foam | Foamer Head | Solvent HLB | Solvent OHLB |
|---|---|---|---|---|---|
| 1:256 Ascend | none | 46 mL | no foam | NA | NA |
| 1:256 Ascend | 1% glycerine | 49 mL | no foam | — | — |
| 1:256 Ascend | 1% propylene glycol | 50 mL | no foam | — | — |
| 1:256 Ascend | 1% dipropylene glycol | 43 mL | no foam | — | — |
| 1:256 Ascend | 1% dipropylene glycol butyl ether | 51 mL | no foam | 6.8 | 20.5 |
| 1:256 Ascend | 1% tripropylene glycol butyl ether | 55 mL | no foam | 6.6 | 20 |
| 1:256 Ascend | 1% diethylene glycol methyl ether | 46 mL | no foam | — | 11.1 |
| 1:256 Ascend | 1% butyl carbitol | 45 mL | flat foam | 7.7 | 12.2 |
| 1:256 Ascend | 1% hexylene glycol | 54 mL | flat foam | — | — |

TABLE 8-continued

| Sample | Solvent Added | Cylinder Foam | Foamer Head | Solvent HLB | Solvent OHLB |
|---|---|---|---|---|---|
| 1:256 Ascend | 1% propylene glycol butyl ether | 48 mL | flat foam | 6.9 | 21 |
| 1:256 Ascend | 1% dipropylene glycol methyl ether | 43 mL | like shaving cream | 8.2 | 12.2 |
| 1:256 Ascend | 1% dipropylene glycol propyl ether | 60 mL | flat foam | 7.2 | 16.2 |
| 1:256 Ascend | 1% ethylene glycol butyl ether | 65 mL | flat foam | 7.4 | 15 |
| 1:256 Ascend | 1% diethylene glycol propyl ether | 47 mL | like shaving cream | — | — |
| 1:256 Ascend | 1% triethylene glycol methyl ether | 48 mL | flat foam | — | — |

Example 3

Effect of Solvent Level on Foam Boosting

A 1:256 dilution of a commercial disinfectant/cleaner available under the name Ascend from Ecolab Inc. was combined with various levels of solvent to test its dispensability as a foam through a mechanical foamer head on an unpressurized bottle. As the data in Table 9 illustrates, a range of solvent concentrations may exist for providing desired foaming through a mechanical foamer head on an unpressurized bottle.

TABLE 9

| Sample | Solvent Added | Cylinder Foam | Foamer Head |
|---|---|---|---|
| 1:256 Ascend | none | 46 mL | no foam |
| 1:256 Ascend | 1% butyl carbitol | 45 mL | flat foam |
| 1:256 Ascend | 2% butyl carbitol | 40 mL | like shaving cream |
| 1:256 Ascend | 5% butyl carbitol | 41 mL | no foam |
| 1:256 Ascend | 8% butyl carbitol | 45 mL | no foam |

Example 4

Effect on Solvent Mixtures on Foam Boosting

A 1:256 dilution of a commercial disinfectant/cleaner available under the name Ascend from Ecolab Inc. was combined with various solvents to test its dispensability as a foam through a mechanical foamer head on an unpressurized bottle. As the data in Table 10 illustrates, without the addition of select solvents the disinfectant use solution does not form a foam through a foamer head. As the below data illustrates, a solvent of low water solubility such as benzyl alcohol may be coupled into solution with a more water soluble solvent to afford a foamability benefit similar to those described in Example 2 above.

TABLE 10

| Sample | Solvent Added | Cylinder Foam | Foamer Head |
|---|---|---|---|
| 1:256 Ascend | none | 46 mL | no foam |
| 1:256 Ascend | 1% benzyl alcohol | none [insoluble] | no foam |
| 1:256 Ascend | 1% benzyl alcohol<br>1% butyl carbitol | none [insoluble] | no foam |
| 1:256 Ascend | 1% benzyl alcohol<br>2% butyl carbitol | 40 mL [hazy] | no foam |
| 1:256 Ascend | 0.5% benzyl alcohol | none [insoluble] | no foam |
| 1:256 Ascend | 0.5% benzyl alcohol<br>1% butyl carbitol | 48 mL [clear soln] | flat foam |
| 1:256 Ascend | 0.5% ethylene glycol phenyl ether | none [insoluble] | no foam |

TABLE 10-continued

| Sample | Solvent Added | Cylinder Foam | Foamer Head |
|---|---|---|---|
| 1:256 Ascend | 0.5% ethylene glycol phenyl ether<br>1% butyl carbitol | 40 mL [clear soln] | flat foam |

Example 5

Glass Cleaner Foam Boosting by Solvent Addition

S.C. Johnson's Windex Glass Cleaner was dispensed through a mechanical foam head on an unpressurized bottle. Without the addition of any solvent, no foam was obtained. With the addition of 2% butyl carbitol, a flat foam was formed. This foam minimized running of the glass cleaner off of a window before it could be wiped away.

Example 6

Hard Surface Cleaner Foam Boosting by Solvent Addition

A 1:256 use dilution of Oasis Pro 10 Heavy Duty All Purpose Degreaser Cleaner, a commercial hard surface cleaner available from Ecolab Inc. was combined with various solvents to test its dispensability as a foam through a mechanical foamer head on an unpressurized bottle. Unlike the cationic and nonionic surfactants in the Ascend disinfectant in previous examples, this cleaning product contains anionic and nonionic surfactants. It also contains 0.02% dipropylene glycol propyl ether, a level insufficient to boost foam sufficiently for dispensing via a mechanical foamer head.

As the data in Table 11 illustrates, without the addition of select solvents the disinfectant use solution does not form a foam through a foamer head. It further demonstrates that this foam boosting effect for mechanical roamer heads on unpressurized containers is not obtained by addition of a conventional amphoteric surfactant at similar levels (Monateric CEM surfactant from Uniqema).

TABLE 11

| Sample | Solvent Added | Foamer Head |
|---|---|---|
| 1:256 Oasis 10 | none | no foam |
| 1:256 Oasis 10 | 0.5% butyl carbitol | like shaving cream |
| 1:256 Oasis 10 | 0.25% butyl carbitol | no foam |

TABLE 11-continued

| Sample | Solvent Added | Foamer Head |
|---|---|---|
| 1:256 Oasis 10 | 0.5% dipropylene glycol propyl ether | like shaving cream |
| 1:256 Oasis 10 | 0.25% dipropylene glycol propyl ether | flat foam |
| 1:256 Oasis 10 | 0.25% dipropylene glycol methyl ether | like shaving cream |
| 1:256 Oasis 10 | 0.13% dipropylene glycol methyl ether | flat foam |
| 1:256 Oasis 10 | 0.13% Monateric CEM surfactant | no foam |

Example 7

Solvent Foam Boosters

Commercial products which gave poor or no foam through a mechanical foamer head (from Zeller) were provided with 0.5 wt. % Dowanol DPM (Dow Chemical) and re-tested through a mechanical foamer head (from Zeller).

The following rating system was used to evaluate the product dispensed through the mechanical foamer head:

None=No foam

Poor=Very scattered foam

Moderate=Flat foam with coverage of spray area as a foam and stable for at least one minute Good=Like shaving cream in appearance The products identified in Table 11 were evaluated for foam before addition of solvent and foam after addition of solvent.

TABLE 11

| | Foam vs. Solvent | | |
|---|---|---|---|
| Manufacturer | Product | Before | After |
| Method Products, Inc. | Method ™ Blue Sky Glass Cleaner | None | Moderate |
| Orange Clean Tough Acting Degreaser & Multi-Purpose Cleaner ® | Orange Glo International | Poor | Moderate |
| Carpet Cleaner ™ | Target | Poor | Good |
| Dawn ® Power Dissolver | Procter & Gamble | Poor | Good |

The addition of 0.5 wt. % dipropylene glycol methyl ether (Dowanol DPM) caused four commercial products that exhibited none to poor foam when processed through a mechanical foaming head without a foam-boosting solvent with moderate to good foam when processed through a mechanical foaming head with the addition of a foam-boosting solvent.

Several commercially available products under the name "Oasis Pro" from Ecolab Inc. were formulated into ready-to-use (RTU) compositions and into ready-to-use modified (RTU Modification) compositions. The compositions were processed through a mechanical foaming head and the foam characteristic of each was evaluated. The results are reported in Table 12. The purpose of each product is reported in Table 13.

TABLE 12

| Ecolab Product | RTU | RTU Modification | Before | After |
|---|---|---|---|---|
| Oasis Pro 10 | 0.5 oz/gal | 0.13% Dowanol DPM* | poor/none | mod/good |

TABLE 12-continued

| Ecolab Product | RTU | RTU Modification | Before | After |
|---|---|---|---|---|
| Oasis Pro 123 | 1 oz/gal | 0.5% Dowanol DPM* | poor/none | mod/good |
| Oasis Pro 16 | 2 oz/gal | 0.1% Dowanol DPM* | poor/none | mod/good |
| Oasis Pro 20 | 0.5 oz/gal | 1% Dowanol DPM* | poor/none | mod/good |
| Oasis Pro 60 | 4 oz/gal | 0.13% Dowanol DPM* | poor/none | mod/good |
| Oasis Pro 64 | 4 oz/gal | 0.5% Dowanol DPM* | poor/none | mod/good |

*Product of Dow Chemical

TABLE 13

| Ecolab Name | Type of Product |
|---|---|
| Oasis Pro 10 | All Purpose Degreaser |
| Oasis Pro 11 | Heavy Duty Multi-Surface Cleaner |
| Oasis Pro 12 | Neutral All Purpose Cleaner |
| Oasis Pro 16 | Orange Multi-Surface Cleaner |
| Oasis Pro 20 | Neutral Cleaner/Disinfectant |
| Oasis Pro 41 | Ammoniated Glass Cleaner |
| Oasis Pro 60 | Alkaline Bathroom Cleaner |
| Oasis Pro 61 | Heavy Duty Bathroom Cleaner |
| Oasis Pro 64 | Toilet Bowl Cleaner |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A foam dispenser comprising:

(a) a container comprising a cleaning composition, wherein the cleaning composition comprises about 0.01 wt. % to about 10 wt. % total amount of surfactant, at least about 80 wt. % water, and glycol ether solvent consisting of one or more glycol ethers each having a HLB value of at least about 6.9 and an OHLB value of between about 12 and about 20, wherein the weight ratio of the foam-boosting solvent to the total amount of surfactant is at least about 1:100 and wherein the cleaning composition is substantially free of propellant; and (b) a mechanical foaming head comprising:

(i) an air and liquid mixing chamber;

(ii) an air inlet for delivering air to the air and liquid mixing chamber;

(iii) a liquid inlet line for delivering the cleaning composition from the container to the air and liquid mixing chamber; and (iv) an outlet line for delivering a mixture of air and cleaning composition from the air and liquid mixing chamber outside of the mechanical foaming head, wherein the mixture includes at least 50% foam.

2. A foam dispenser unit according to claim 1, wherein the dispenser head further comprises a screen provided within the outlet line.

3. A foam dispenser according to claim 1, wherein the cleaning composition comprises between about 0.1 wt. % and about 5 wt. % of the glycol ether.

4. A foam dispenser according to claim 1, wherein the cleaning composition comprises between about 0.5 wt. % and about 3 wt. % of the glycol ether.

5. A foam dispenser according to claim 1, wherein the weight ratio of the glycol ether to the total amount of surfactant is between about 1:40 and about 40:1.

6. A foam dispenser according to claim 1, wherein the weight ratio of the glycol ether to the total amount of surfactant is between about .05:1 and about 20:1.

7. A foam dispenser according to claim 1, wherein the glycol ether has the formula:

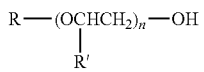

wherein R is a $C_1$-$C_6$ aliphatic or aromatic group, R' is H, $CH_3$, or $C_2H_5$, and n has a value of at least 1.

8. A foam dispenser according to claim 1, wherein the glycol ether comprises at least one of propylene glycol butyl ether, dipropylene glycol methyl ether, dipropylene glycol propyl ether, ethylene glycol butyl ether diethylene glycol propyl ether, and triethylene glycol methyl ether.

9. A foam dispenser according to claim 1, wherein the glycol ether comprises a derivative of a glycol ether having the formula:

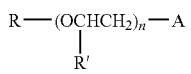

wherein R is a $C_1$-$C_6$ aliphatic or aromatic group, R' is H, $CH_3$, or $C_2H_5$, n has a value of at least 1, and A comprises at least one of an ester, an amide, and an ether.

10. A foam dispenser according to claim 1, wherein the derivative of a glycol ether comprises propylene glycol methyl ether acetate.

11. A foam dispenser according to claim 1, wherein the glycol ether comprises glycol having at least four carbon atoms.

12. A foam dispenser according to claim 1, wherein the foaming dispenser head comprises a trigger that is constructed to be actuated by finger pressure.

13. A foam dispenser according to claim 1, wherein the foam dispenser provides a composition containing at least 50 wt. % foam according to a 15 second vertical separation test.

14. A foam dispenser according to claim 1, wherein the foam dispenser provides a foam having less than 1 ppm non-air containing propellant when measured using a gas chromatographic head space analysis.

15. A foam dispenser comprising:

(a) a container comprising a cleaning composition, wherein the cleaning composition comprises about 0.01 wt. % to about 10 wt. % total amount of surfactant, at least about 80 wt. % water, and glycol solvent selected from the group consisting of n-propoxypropanol, propylene glycol butyl ether, dipropylene glycol methyl ether, dipropylene glycol propyl ether, ethylene glycol butyl ether, dipropylene glycol methyl ether, and triethylene glycol methyl ether, and wherein the cleaning composition is substantially free of a propellant; and (b) a mechanical foaming head comprising:

(i) an air and liquid mixing chamber;

(ii) an air inlet for delivering air to the air and liquid mixing chamber;

(iii) a liquid inlet line for delivering the cleaning composition from the container to the air and liquid mixing chamber; and (iv) an outlet line for delivering a mixture of air and the cleaning composition from the air and liquid mixing chamber outside of the mechanical foaming head, wherein the mixture includes at least 50% foam.

* * * * *

UNITED STATES PATENT AND TRADEMARK OFFICE

CERTIFICATE OF CORRECTION

PATENT NO. : 7,666,826 B2
APPLICATION NO. : 10/852591
DATED : February 23, 2010
INVENTOR(S) : Smith et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1162 days.

Signed and Sealed this

Seventh Day of December, 2010

David J. Kappos

David J. Kappos
*Director of the United States Patent and Trademark Office*